US005154633A

United States Patent [19]

Lee

[11] Patent Number: 5,154,633

[45] Date of Patent: Oct. 13, 1992

[54] CONDUCTOR SOCKET

[76] Inventor: Meng L. Lee, 15, Hu Tsai Road, Lin Kou Hsiang, Taipei, Taiwan

[21] Appl. No.: 637,322

[22] Filed: Jan. 3, 1991

[51] Int. Cl.[5] ..... H01R 4/24

[52] U.S. Cl. ..... 439/409

[58] Field of Search ..... 439/389–425

[56] References Cited

U.S. PATENT DOCUMENTS 3,877,774 4/1975 Dorrell ..... 439/409

*Primary Examiner*—Joseph H. McGlynn

[57] ABSTRACT

A conductor socket is disclosed which has a pressing plate and a turning handle with shaft hole. The plate and the bottom of the turning handle define many channels and pressing flanges, respectively. The socket itself also defines many channels to accommodate various conductors. Movement of the pressing plate and the turning handle will connect the multiple conductors without the need to have an instrument to peel off the cable insulator or to be fastened by a screw.

2 Claims, 3 Drawing Sheets

CONDUCTOR SOCKET

BACKGROUND OF THE INVENTION

The invention relates to a conductor socket to be utilized for multiple conductor wires, or between parallel wires so that the various wires can be easily connected.

Currently in the normal practice for phone sockets, various electrical appliances, transformers and other electrical assemblies, it is necessary to use instruments to peel off the cable tip wrappings and then match same color connector wires. To complete the connecting, it is further required to screw both lines in a fixed position.

In a typical example of the prior art, the attached FIG. 4, illustrates a phone socket. At the inner side of the phone facia 11, there is a phone socket 12, and conductor wire 13 is linked with the post 15 via the fixing screw 14. If it is linked with the post 15 via the fixing screw 14. If it is desired to attach the outdoor wires (not shown in the figure) to the phone set, the worker needs to peel off a small portion of the insulation from the wire tip. Then he must unfasten screws 14 in sequence and attach the same color wire, winding the naked wire around each corresponding post 15. Finally the worker needs to fasten screws 14 in order to finish the job.

It can easily be seen that the worker needs to repeat this process four times because there are four outdoor wires needing to be connected with the corresponding phone wires. If we are doing the same connecting job for a alarming system, which has eight wires, or other multiple conductor lines or parallel lines socket, we need to duplicate our actions even more times in order to complete the connections.

It is apparent that this practice is not economical and is also very inconvenient in view of the wastage of labor hours. The manufacturing factory (sockets, connecting terminal plants), the professional worker (indoor circuit layout), or the customer who wants to install the phone set by himself, all have to use tools to repeat the above mentioned actions. This is tedious and not practical.

SUMMARY OF THE INVENTION

This invention is originated to resolve the above disadvantages for the connection of wires, conductors, and parallel lines. It is quick, more efficient and especially excellent for a phone set facia to connect the phone's wire with outdoor wires. It is also very useful for transfer sockets and electrical appliances to enable the connection of the multiple wires and conductors. It has the characteristics of speediness and simplification of the construction project.

The major purposes of the invention are to provide a new method to connect various wires or conductors without the requirements of any tools to save time and also save energy.

Another purpose of this invention is to provide an easy structured and inexpensive socket with few components so that it is easy to produce and is also convenient for the worker to assembly. Using this design, the construction difficulty of the socket connection can be eliminated and the construction quality can be upgraded.

DETAILED DESCRIPTION OF THE PREFERRED EMBODIMENT

Figure 1:
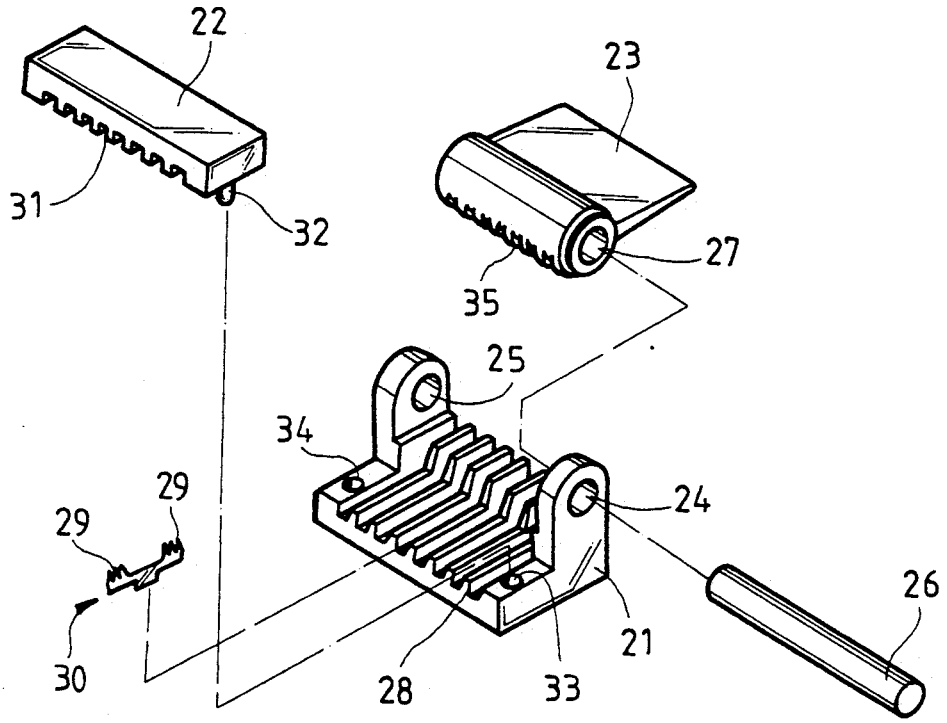
FIG. 1 is a exploded view of the conductor socket of the invention.
Figure 2:
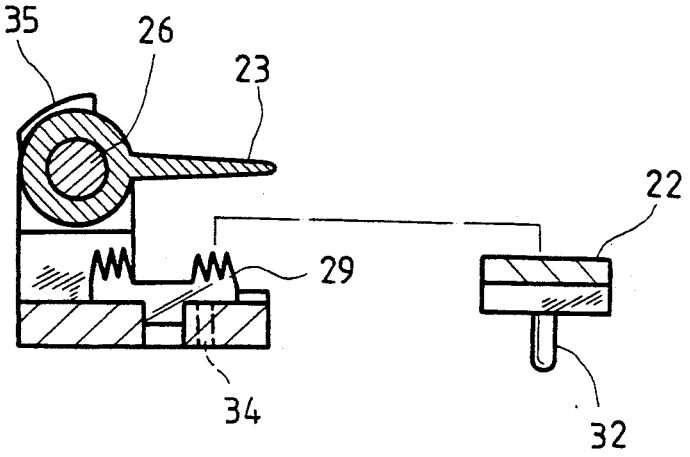
FIG. 2 is a side view of the assembly of the invention.
Figure 3:
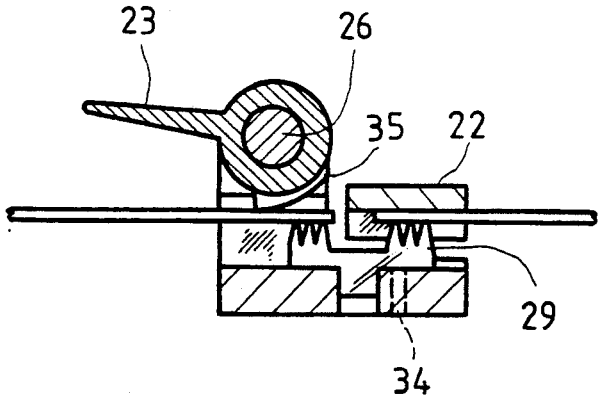
FIG. 3 is a side view of the conductor wires connection.
Figure 4:
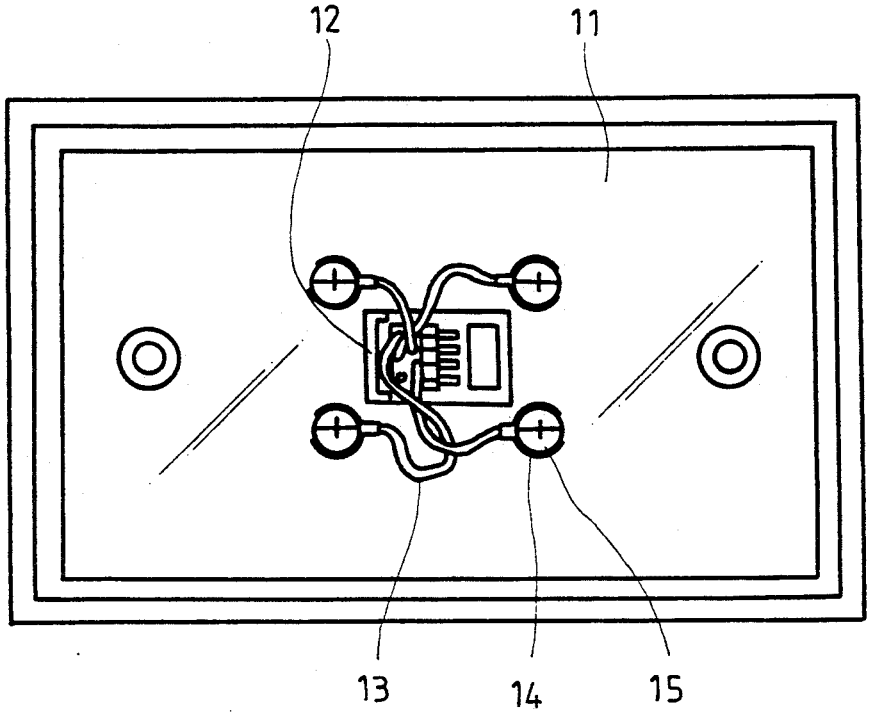
FIG.4(PRIOR ART)
FIG. 4 is a rear view phone set fascia according to the prior art.
Figure 5:
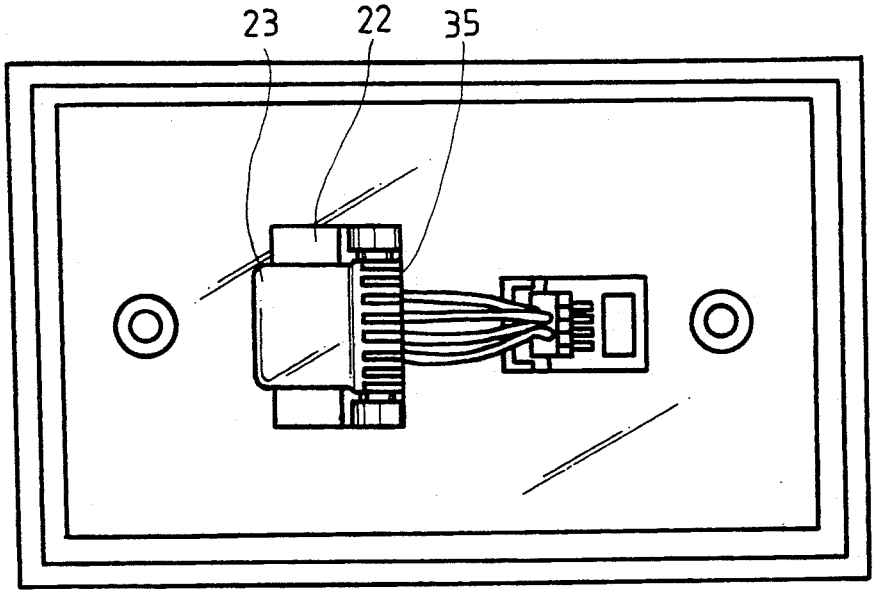
FIG. 5 is a rear view of the present invention incorporated in a phone set fascia.

As indicated in FIG. 1, the conductor socket body has one socket body 21, a pressing plate 22 and a turning handle 23.

The socket body 21 has two holes 24, 25 on its two enlarged ends. The holes allow the shaft 26 to penetrate. In the turning handle, there is also a hole 27 to allow the handle 23 to be connected to the socket body 21 by shaft 26. The socket body 21 has various channels 28 which extend from the front to the back. Every channel 28 is located between two holes 24 and 25, and the front portion is slightly higher than the rear portion. Every channel 28 can accommodate a metal line connector 30 with both ends having teeth 29. This is the socket body 21.

Pressing plate 22 is a flat material. At its bottom, there are a plurality of wire channels 31. There are two downwardly extending poles 32 near the edges of the pressing plate 22 (in the figure you can only see one such poles). These two poles can be placed into socket body 21 holes 33, 34 so as to incorporate the pressing plate 22 with the socket body 21. Each wire channel 31 of the pressing plate 22 is aligned with a channel 28 of the socket body 21. With is incorporation, a conductor may be accommodated into each channel 28.

Turning handle 23 includes the handle's hole 27 of which can allow the shaft 26 to penetrate to join it to the socket body 21. At the handle's hole 27, there are a plurality of compressing teeth 35. When the turning handle 23 is connected with the socket body 21, the compressing teeth 35 are located on top of the front portion of the channels 28. If the turning handle 23 is turned, it will then cause each pressing tooth 35 to go into a corresponding channel 28.

When it is desired to connect two sets of multiple wire sets, the pressing plate 22 is taken off and each conductor line is placed in the rear portion of each channel 28. Then the pressing plate 22 is put back on the socket body 21. This completes the process of the connection. All conductor lines are attached to the metal plate 30 fixing teeth 29. (Those assembly works have been done in the manufacturing factory already).

Another of the multiple wire sets is put into channels 28 near the bottom of the turning handle 23 following the proper color sequence. Pushing the turning handle 23 downwards will cause the compressing teeth 35 to contact the conductor lines, pushing them into the channels 28 to connect them to the metal plate 30. At this stage, two sets of multiple wire sets are connected.

While in the fabrication process, the socket body channel can be modified to meet different requirements. It can have different numbers of channels as well as different depths of channels to fit various wires. The socket body can be designed to be part of its mother product and it can also be designed as an independent socket to be inserted into fascia or transformer.

It can be fabricated in various shapes to be used in different electrical appliances. Because of its convenience, it requires no tools; it will simplify the work of the assembly; and it can save time and effort.

I claim:

1. A conductor socket comprising:

a) a socket body defining a plurality of generally parallel channels adapted to receive ends of insulated conductor wires;

b) electrically conductive line connectors disposed in the channels, each line connector having insulation piercing teeth thereon;

c) a pressing plate adapted to be attached to the socket body so as to urge ends of first conductor wires into electrical contact with the line connectors;

d) a turning member defining a plurality of compressing teeth;

e) means to pivotally attach the turning member to the socket body such that the turning member is pivotable about an axis between a first position wherein the compressing teeth are located out of the channels and a second position wherein the compressing teeth extend into the channels; and, f) a generally planar, lever-type handle extending from the turning member in a generally radial direction from a pivot axis to facilitate the manual movement of the turning member between its first and second positions.

2. The conductor socket of claim 1 wherein the means to attach the turning member to the socket body comprises:

a) a pair of aligned first holes defined by the socket body member;

b) a second hole defined by the turning member; and, c) a shaft passing through the first and second holes.

* * * * *